US008069587B2

(12) United States Patent
Purrington et al.

(10) Patent No.: US 8,069,587 B2
(45) Date of Patent: Dec. 6, 2011

(54) MOLDED INSULATED SHOE FOOTBED AND METHOD OF MAKING AN INSULATED FOOTBED

(75) Inventors: Scott M. Purrington, Grant, MN (US); Frank Roppolo, Bridgewater, MA (US)

(73) Assignee: 3M Innovative Properties Company, St. Paul, MN (US)

( * ) Notice: Subject to any disclaimer, the term of this patent is extended or adjusted under 35 U.S.C. 154(b) by 596 days.

(21) Appl. No.: 12/274,557

(22) Filed: Nov. 20, 2008
(Under 37 CFR 1.47)

(65) Prior Publication Data

US 2010/0122475 A1 May 20, 2010

(51) Int. Cl.
*A43B 13/38* (2006.01)

(52) U.S. Cl. ..... 36/44; 36/181; 12/142 N

(58) Field of Classification Search ..... 36/43, 44, 36/88, 154, 178, 181; 12/142 N
See application file for complete search history.

(56) References Cited

U.S. PATENT DOCUMENTS

| | | | | | |
|---|---|---|---|---|---|
| 4,055,699 | A | * | 10/1977 | Hsiung | 36/44 |
| 4,118,531 | A | | 10/1978 | Hauser | |
| 4,223,458 | A | * | 9/1980 | Kihara | 36/44 |
| 4,257,176 | A | * | 3/1981 | Hartung et al. | 36/44 |
| 4,464,850 | A | | 8/1984 | Ebert et al. | |
| 4,510,700 | A | | 4/1985 | Brown | |
| 4,586,273 | A | * | 5/1986 | Chapnick | 36/44 |
| 4,658,515 | A | | 4/1987 | Oatman | |
| 4,782,605 | A | * | 11/1988 | Chapnick | 36/44 |
| 4,831,749 | A | | 5/1989 | Tsai | |
| 4,910,055 | A | | 3/1990 | Wigutow | |
| 4,932,141 | A | | 6/1990 | Hones | |
| 4,933,129 | A | | 6/1990 | Huykman | |
| 5,022,168 | A | | 6/1991 | Jeppson, III et al. | |
| 5,123,180 | A | * | 6/1992 | Nannig et al. | 36/43 |
| 5,388,349 | A | | 2/1995 | Ogden | |
| 5,565,154 | A | | 10/1996 | McGregor et al. | |
| 5,639,700 | A | | 6/1997 | Braun et al. | |
| 5,697,106 | A | * | 12/1997 | Baker et al. | 2/239 |
| 5,860,163 | A | | 1/1999 | Aldridge | |
| 5,946,825 | A | | 9/1999 | Koh et al. | |
| 5,994,245 | A | * | 11/1999 | Marier et al. | 442/373 |

(Continued)

FOREIGN PATENT DOCUMENTS

JP 06-011241 2/1994

(Continued)

OTHER PUBLICATIONS

Davies, C.N., *The Separation of Airborne Dust and Particles* ,Institution of Mechanical Engineers, London Proceedings 1B (1952).

(Continued)

*Primary Examiner* — Marie Patterson
(74) *Attorney, Agent, or Firm* — Karl G. Hanson

(57) ABSTRACT

A shoe footbed 10 made by first molding a shape-retaining layer 12 into a contoured condition. After the shape-retaining layer 12 has been molded, a layer of thermal insulation 14 is placed on top of the molded layer 12. A conforming layer 16 and a fabric top layer 18 may be placed over the thermal insulation 14 and the shape-retaining layer 12. The inventive method of manufacture is particularly suited for making insulated footbeds that contain nonwoven webs of polymeric microfiber because damage to the fibrous web from heat and compression may be avoided.

18 Claims, 3 Drawing Sheets

U.S. PATENT DOCUMENTS

| | | | | |
|---|---|---|---|---|
| 6,041,437 | A | 3/2000 | Barker et al. | |
| 6,068,882 | A | 5/2000 | Ryu | |
| 6,077,597 | A | 6/2000 | Pause | |
| 6,139,308 | A | 10/2000 | Berrigan | |
| 6,219,941 | B1 | 4/2001 | Kukoff | |
| 6,338,768 | B1 | 1/2002 | Chi | |
| 6,397,401 | B2 | 6/2002 | Belcher | |
| 6,492,286 | B1 | 12/2002 | Berrigan et al. | |
| 6,560,902 | B1 * | 5/2003 | Eschweiler | 36/44 |
| 6,946,196 | B2 * | 9/2005 | Foss | 428/373 |
| 7,078,359 | B2 | 7/2006 | Stepanian et al. | |
| 7,360,325 | B2 * | 4/2008 | Chen | 36/44 |
| 7,410,684 | B2 | 8/2008 | McCormick | |
| 2006/0125158 | A1 | 6/2006 | Rouanet et al. | |
| 2006/0254088 | A1 | 11/2006 | McCormick | |
| 2007/0234595 | A1 | 10/2007 | Davis | |

FOREIGN PATENT DOCUMENTS

| | | | |
|---|---|---|---|
| JP | 3034179 | | 2/1997 |
| WO | WO 99/36725 | | 7/1999 |
| WO | WO 02/52086 | A2 | 4/2002 |
| WO | WOX 2006/009921 | A2 | 1/2006 |
| WO | WO 2008/064123 | A1 | 5/2008 |

OTHER PUBLICATIONS

V.A. Wente et al., Report No. 4364 of the Naval Research Laboratories, published May 25, 1954, entitled *Manufacture of Super Fine Organic Fibers*.

International Search Report for PCT/US2009/063339 dated Jun. 18, 2010.

* cited by examiner

MOLDED INSULATED SHOE FOOTBED AND METHOD OF MAKING AN INSULATED FOOTBED

The present invention pertains to a shoe footbed that has a molded shape-retaining layer that has a contour molded into it and that contains polymeric microfibers.

The present invention also pertains to a method of making a shoe footbed where the shape-retaining layer is first molded before having a layer of thermal insulation juxtaposed against it.

BACKGROUND

Thermal insulation that contains polymeric microfibers has been known for many years. This insulation is commonly used in jackets and sleeping bags to provide heat retention (see, for example, U.S. Pat. No. 5,565,154 to McGregor et al. and U.S. Pat. No. 4,933,129 to Hukman). Microfiber-containing insulation also has been used in shoes to assist in keeping a wearer's feet warm.

Non-woven microfibrous webs, however, are sometimes subject to compression, which can reduce web loft and can cause a reduction in heat retention. In addressing this compression problem, investigators have corrugated nonwoven webs that contain microfibers (see U.S. Pat. No. 5,639,700 to Braun) and have introduced crimped staple fibers into the web (see U.S. Pat. No. 4,118,531 to Hauser). The 3M Company sells such microfiber-containing nonwoven insulation under the brand Thinsulate™.

Molding operations sometimes are used to make shoe footbeds, insoles, or inserts. The molding step enables these shoe products to have a shape that is anatomically adapted to the human foot (see, for example, U.S. Pat. Nos. 4,510,700 to Brown and 4,932,141 to Hones).

Shoe footbeds also have been developed which use a layer of thermal insulation to protect the wearer's feet from cold ambient temperatures (see, for example, U.S. Pat. No. 4,464,850 to Ebert et al. and U.S. Pat. No. 4,658,515 to Oatman) Known molded shoe footbeds, however, have not used thermal insulation that contains nonwoven webs of polymeric microfibers.

Processing articles that contain non-woven polymeric microfibrous webs can sometimes be problematic. Because polymeric microfibers are subject to changes in morphology and structure when subjected to heat for only short time periods—and because some molding operations occur at temperatures at or above the melting temperature of the microfibers—the web and its heat retention capabilities may become damaged during subsequent molding operations. Manufacturers accordingly tend to avoid using low melting point, polymeric, microfiber-containing webs in operations where web loft and fiber integrity need to be maintained.

SUMMARY OF THE INVENTION

The present invention provides a new method of making a shoe footbed, which method comprises the steps of (a) molding a sheet into a shape-retaining layer that has first and second major surfaces and that has a contour molded into the second major surface; (b) juxtapositioning a thermal insulation layer, which comprises a non-woven web that contains microfibers and which has first and second major surfaces, onto the molded shape-retaining layer such that the first major surface of the insulation faces the second major surface of the shape-retaining layer; and (c) juxtapositioning one or more layers of a third material against at least the second major surface of the thermal insulation.

The present invention also provides a new shoe footbed that comprises (a) a shape-retaining layer that has first and second major surfaces and that has a contour molded into the second major surface; (b) a non-woven web that contains polymeric microfibers, the non-woven web being disposed on the shape-retaining layer such that the first major surface of the non-woven web faces the second major surface of the shape-retaining layer and such that the web has a loft of at least 5 cubic centimeters per gram; and (c) one or more layers of a third material that is juxtaposed against at least the second major surface of the non-woven web.

In the present invention, a shoe footbed is made by first molding a sheet material into a contoured shape-retaining layer. Following the molding step, a layer of thermal insulation is juxtaposed against the shape-retaining layer. One or more layers of a third material is positioned upon the layer of thermal insulation and optionally upon the top surface of the contoured shape-retaining layer. Because the shape-retaining layer is molded before the thermal insulation is placed on the second major surface of the shape-retaining layer, there is no risk for damaging the thermal insulation from exposure to heat during the molding step. Accordingly, the method of the present invention is particularly suited for enabling footbeds to be created which use non-woven webs that contain polymeric microfibers for the thermal insulation. Using the inventive method, shoe footbeds may be created that have lofty microfibrous insulation.

GLOSSARY

"air-permeable" means that no more than two minutes are needed to pass 100 cubic centimeters ($cm^3$) of air through a 6.35 square centimeter ($cm^2$) area of the sample under a pressure of 124 millimeters water ($mmH_2O$) using the test method described in ASTM D-726-58;

"cavity" means a recess sized and adapted for receiving another item;

"conforming layer" means a layer that compresses in response to force (for example, the weight of a person's foot) applied normally to a major surface of the layer and that expands when that force is removed;

"comprises (or comprising)" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the footbed in serving its intended function;

"contour" means shaped to accommodate the human foot in the form of raised sections that are designed to conform around at least one or more of the heel or midfoot (arch) areas;

"cut-to-size" means a section of the footbed in the toe region where a user can custom cut the footbed to fit their footwear;

"dab" means a small amount so as to not have a significant detrimental effect on overall permeability, insulation, or stiffness;

"end user" means a final user of the product, that is, a person who uses the footbed in their footwear;

"footbed" means an article adapted for placement in the shoe interior beneath the wearer's foot when the shoe is worn;

"juxtaposed" means placed adjacent to but not necessarily in direct contact with;

"microfibers" means fibers that have an effective fiber diameter of about 20 micrometers (μm) or less;

"molded" means placing into a desired shape through application of heat and pressure;

"shape-retaining layer" means a layer of material that furnishes the footbed with an intended shape;

"shoe footbed" means a part that is fashioned for placement in a shoe such that it would be juxtaposed against the bottom of a person's foot during use;

"textile" means a planar structure that contains yarns or fibers;

"thermal insulation layer" means one or more layers of material that are designed for reducing heat passage;

DETAILED DESCRIPTION OF PREFERRED EMBODIMENTS

In the practice of the present invention, a shoe footbed is provided that is able to use microfiber-containing thermal insulation in a manner that protects the nonwoven web from compression and from heat-related damage during shoe manufacture. Molded shoe footbeds are commonly exposed to heat and pressure during production. These elements may detrimentally alter the structure of a thermal insulation layer and accordingly adversely affect its thermal performance. Using a method of making a shoe footbed according to the present invention, the resulting product is able to be structured such that the thermal insulation layer is protected during manufacture. In the present invention, the microfiber-containing layer is not exposed to heat and pressure when the footbed is molded. The original structural properties of the insulation layer, particularly its loft, therefore can be better preserved, allowing better retention of the thermal properties.

Figure 1:
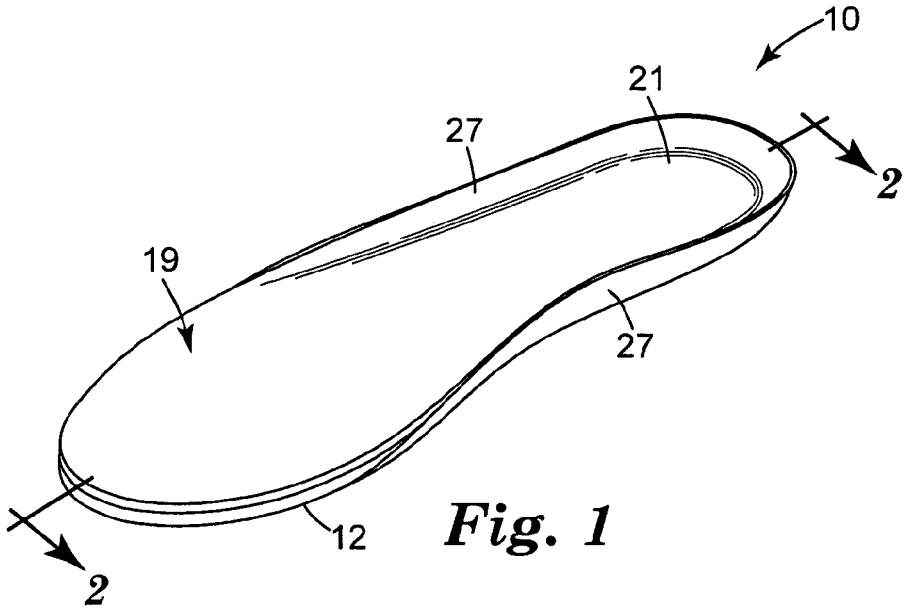
FIG. 1 is a perspective view of a shoe footbed 10 in accordance with the present invention.
Figure 2:
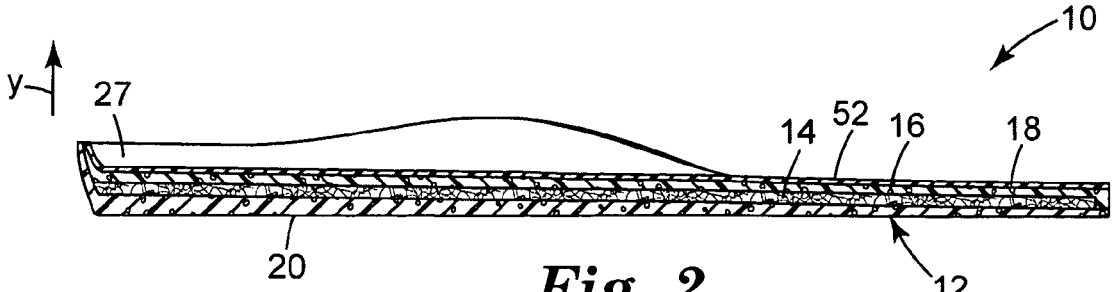
FIG. 2 is a cross-section of a shoe footbed 10 taken along lines 2-2 of FIG. 1.
Figure 3:
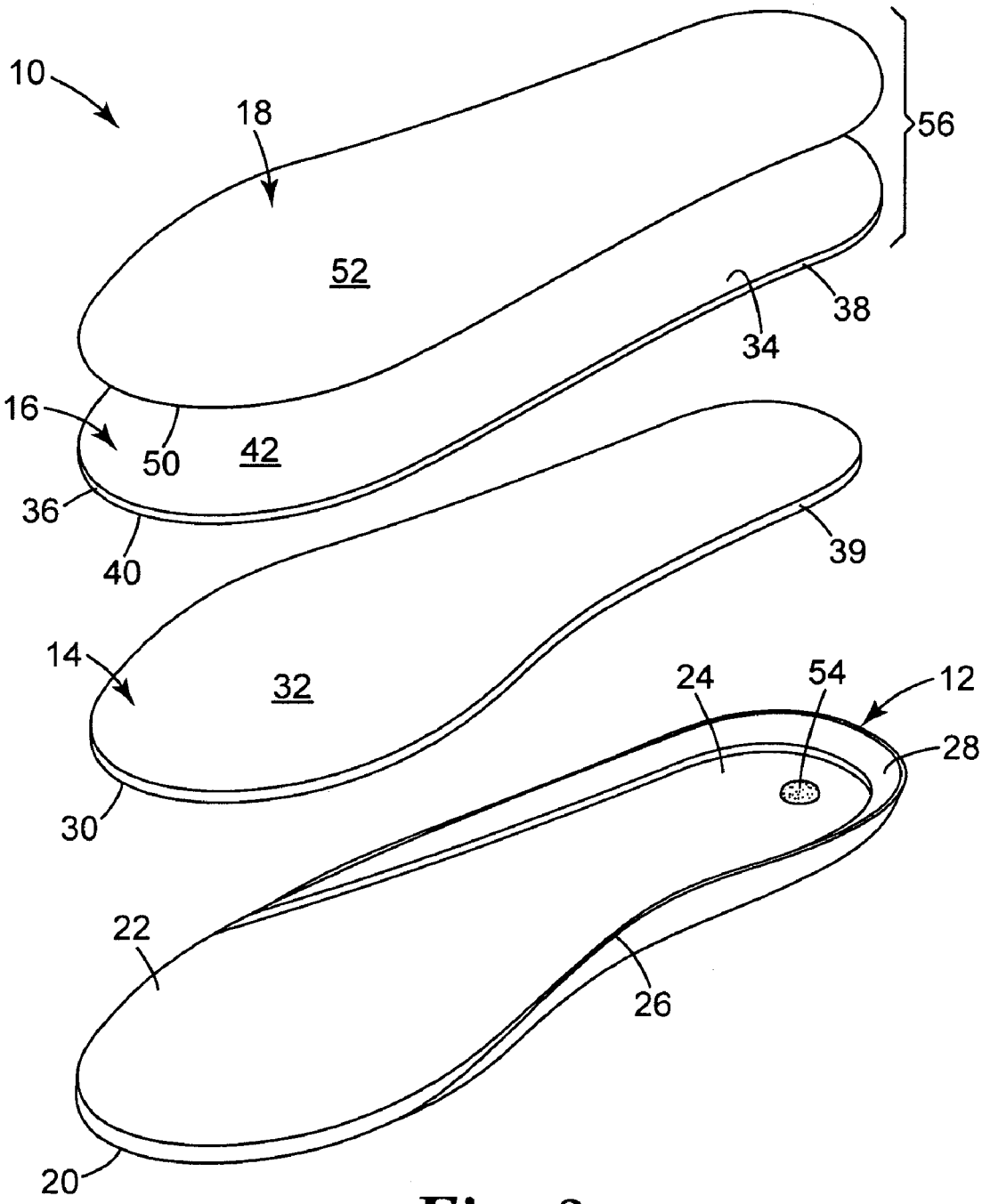
FIG. 3 is a expanded view of a shoe footbed 10, showing individual layers, in accordance with the present invention.

FIGS. 1-3 show an example of a shoe footbed 10, which has a shape-retaining layer 12, a layer of thermal insulation 14, a conforming layer 16, and a top cover fabric 18. The footbed 10 includes a fore-part 19 and a heel-part 21. The finished footbed is contoured to improve wearer fit and comfort. The shape-retaining layer 12 has first and second major surfaces 20 and 22, respectively, and a contour molded into at least the second top surface 22 thereof. The contour may include a cavity 24 for receiving the thermal insulation 14 and an arch 26 and a heel cup 28 for accommodating a person's foot. The heel cup, for example, may be raised relative to the forepart to provide extra comfort in this high pressure region. The maximum topographical change in shape from the main plane of the top surface of the footbed 10 in at least the "y" dimension, may be at least 0.5 centimeters (cm) to about 2 cm in at least some, and perhaps most, parts of the contoured area. The contoured configuration of the footbed 10 may provide sidewalls 27 that angle upwardly from the top surface at an angle of at least about 5 to about 90 degrees, more typically 10° to 75° in at least some, and perhaps most, parts of the contoured area. The thermal insulation layer 14 has first and second major surfaces 30 and 32 and may comprise a nonwoven web that contains polymeric microfibers. The thermal insulation layer 14 may be disposed in the cavity 24 of the molded shape-retaining layer 12 when the footbed is assembled. The cavity 24 can be structured to surround the whole periphery of the thermal insulation or a portion of it. The cavity 24 may encompass, for example, the perimeter of the heel portion 25 of the thermal insulation or the whole perimeter of layer 14. The cavity may be, for example, about 2 to 10 millimeters (mm) deep. The conforming layer 16 is juxtaposed against the second major surface 22 of the molded shape-retaining layer 12 and the second major surface 32 of the thermal insulation 14. The conforming layer 16 typically has approximately the same length as the shape-retaining layer 12 from the heel end 34 to the toe end 36. The perimeter 38 of the conforming layer 16 may be generally shaped to correspond to the perimeter 39 of the insulation layer 14 but is generally larger in size. The conforming layer 16 has first and second major surfaces 40 and 42, with the first major surface 40 facing the second major surface 32 of the thermal insulation 14. The top fabric layer 18 too has first and second major surfaces 50 and 52 and is juxtaposed against the second major surface 42 of the conforming layer 16.

The various layers that comprise the footbed may be secured together using an adhesive 54 at one or more locations. The adhesive may be applied in the form of "dabs" at select locations or across the whole surface or portions thereof. The adhesive may be sprayed, brushed, roll coated, printed, or applied continuously or discontinuously by any other suitable method. The entire construction of the shoe footbed may be permeable to air due to the choice of materials as well as the molding and assembly processes. The air permeability of the total footbed typically is less than 60 seconds, more typically less than 20 seconds, for 100 $cm^3$ of air to pass through the sample under ASTM D-726-58.

The shape-retaining layer may be, for example, an air-permeable, open cell, polyurethane foam. The foam may contain between, for example, 50% and 70% by weight of recycled foam and one or more pigments for aesthetics. The shape-retaining layer also may comprise other polymers such as ethylene vinyl acetate, polyethylene, polypropylene, or combinations thereof. These polymers too may be in the form of an open-cell, air-permeable foam. The shape-retaining layer also may be treated with an antimicrobial agent to reduce odor-causing microorganisms. Examples of such antimicrobial agents include: silane functionalized quaternary amines such as Microbe Shield™ available from AEGIS Environments; colloidal silver solutions such as Silpure™ available from Thompson Research Associates, Canada, silver chelated polymer solutions such as SilvaDur™ available from Rohm & Haas; and biguanides such as polyhexamethylene biguanide sold under the trade names Vantocil™ and Cosmocil™ available from Arch Chemicals. The first major surface 20 of the shape-retaining layer may be molded to include a decorative pattern and/or with a brand logo and/or with "cut-to-size" marking(s) while the second surface may be molded to contain, for example, a recessed cavity, an arch, and a heel sidewall.

The insulation layer may be cut to a size that has a smaller perimeter than the shape-retaining layer in the toe section to allow an end-user to cut the footbed to their particular shoe size without cutting into the insulation layer. The insulation may be made from a high thermal resistance material to provide good thermal protection in a thin profile. A footbed that is too thick may provide the end-user with an uncomfortable fit. A nonwoven insulation that contains polymeric microfibers—such as meltblown microfibers (BMF), spunbond microfibers, or dry laid microfibers—may be used. Such layer(s) may be made from polypropylene, polyethylene terephthalate (PET), polybutylene terephthalate, polyethylene, polyurethane, nylon, polylactic acid, and combinations thereof. Natural fibers such as cotton, wool, bamboo, hemp, silk, or milkweed also may be used. Some of these fibers may be in microfiber form; others may not. The natural fibers also may be used in conjunction with the synthetic polymeric microfibers. Microfibers typically have an average effective fiber diameter of about 20 μm or less but more commonly are about 1 to about 15 μm, and still more commonly be about 3 to 12 μm in diameter. Effective fiber diameter may be calculated using equation number 12 in Davies, C. N., *The Separation of Airborne Dust and Particles*, Institution Of Mechanical Engineers, London, Proceedings 1B. 1952. BMF webs can be formed as described in Wente, Van A., *Superfine Thermoplastic Fibers in Industrial Engineering Chemistry*, vol. 48, pages 1342 et seq. (1956) or in Report No. 4364 of the Naval Research Laboratories, published May 25, 1954, entitled *Manufacture of Superfine Organic Fibers* by Wente, Van A., Boone, C. D., and Fluharty, E. L. Meltblown microfiber webs can be uniformly prepared and may contain multiple layers, like the webs described in U.S. Pat. Nos. 6,492,286B1 and 6,139,308 to Berrigan et al. When randomly entangled in a web, BMF webs can have sufficient integrity to be handled by themselves as a mat. A fibrous web comprising microfibers that average less than about 10 micrometers in diameter and crimped bulking fibers that have about 8 to 12 crimps per inch (3 to 5 crimps per cm), may be a particularly effective thermal insulator. The microfibers and crimped bulking fibers can be present in a weight ratio of between about 9:1 and 1:9 and may be randomly and thoroughly intermixed and intertangled with one another to form a resiliently compressible fiber structure. A typical web used in connection with the present invention can have a loft of at least about 5 cubic centimeters/gram ($cm^3/g$), more typically about 10 to 35 $cm^3/g$. An aerogel or aerogel composite also can be a suitable insulation. Thermal insulation that contains microfibers is described in, for example, U.S. Pat. No. 4,118,531 to Hauser. Thermal insulation that contains aerogel(s) is described in U.S. Pat. Nos. 6,068,882 and 7,078,359 and U.S. Patent Application 2006/125158. The thermal insulation layer, which is used in connection with the present invention, may exhibit a thermal resistance of at least about 0.01 square meters Kelvin per watt ($m^2K/W$), more typically at least about 0.03 $m^2K/W$. At the upper end, the thermal resistance of the insulation layer is typically less than 0.10 $m^2K/W$. The overall footbed may exhibit a thermal resistance of at least about 0.06 $m^2k/w$, more typically at least about 0.08 $m^2K/W$. Typically, the thermal insulation layer(s) will provide about 30 to 80% of the total thermal resistance of the article.

A conforming layer may be provided to contribute to the cushioning properties of the footbed. An open cell, polyurethane foam, for example, may be used to provide a slow recovery following compression, thereby offering soft, conforming comfort to the wearer (see, for example, U.S. Pat. No. 5,946,825 to Koh et al. and U.S. Patent Application 2007/02345595 to Davis). An alternative to a slow recovery foam may be a low density foam that contains polyurethane or other polymers which compress easily under the weight of the foot and recovers when the force is removed . Like the shape-retaining layer and the thermal insulation layer, the conforming layer too may be air-permeable.

The top fabric layer may be adhesively bonded to the second surface of the conforming layer to create a combination structure 56. The top layer 18 may be a textile such as a knit polyester, which provides air-permeability, abrasion resistance, and an attractive appearance. The top layer also may be treated with an antimicrobial agent to inhibit the growth of odor-causing bacteria. The top layer may too contain a surfactant to wick moisture to promote a feeling of dryness to the end-user. Alternative abrasion resistance top cover materials include other knit, woven, or nonwoven textiles such as Cambrelle™ by Camtex Fabric, Ltd, UK or Dri-Lex™ fabric by Faytex Corp., Weymouth, Mass. An indicia such as a heat-laminated logo can be applied to the second surface of the top fabric layer.

Figure 4:
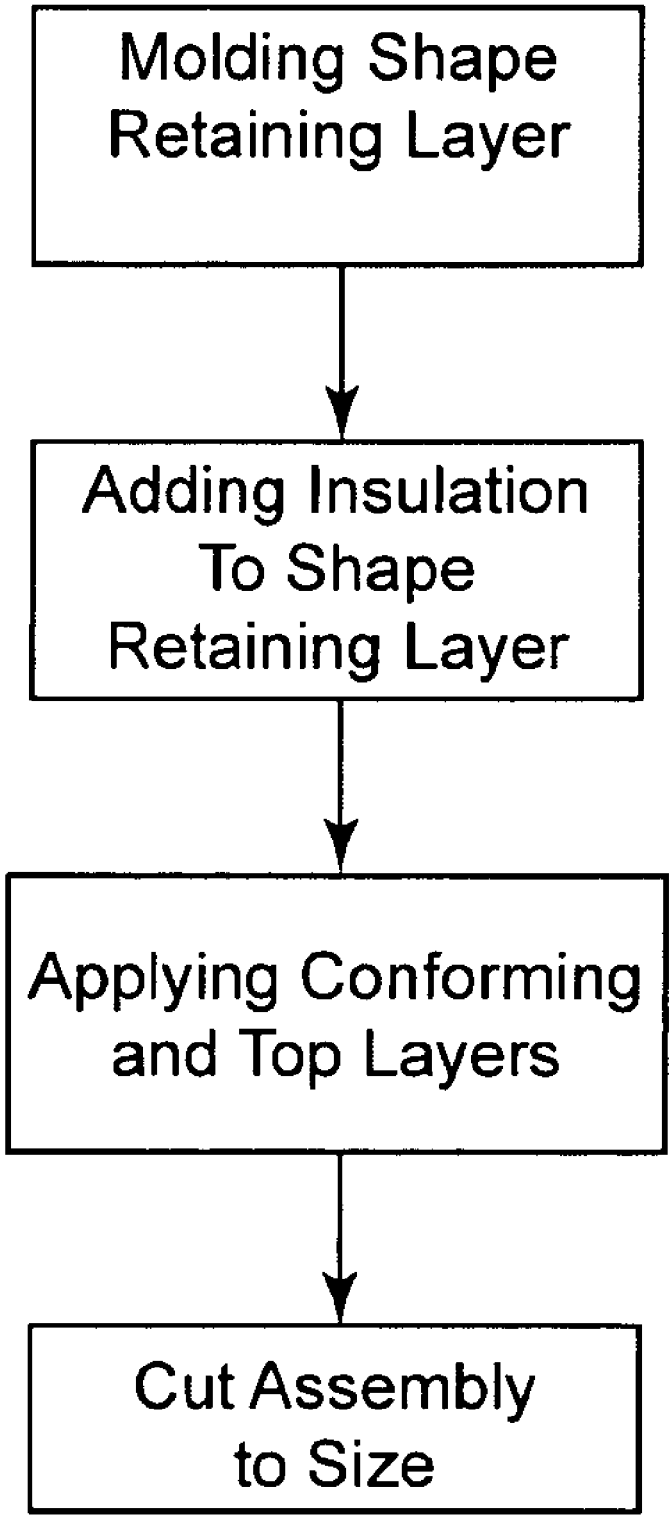
FIG. 4 is a flow chart, illustrating steps that may be used in making a shoe footbed in accordance with the method of the present invention.

The complete footbed may have a total thickness of about 3 to 20 mm, with an approximate typical breakout as follows: shaping layer being to about 2 mm in the forepart to about 6 mm in the heel; thermal insulation layer being about 2 mm; third conforming layer being about 3 to 4 mm, and the fourth fabric layer being about 0.5 mm. The thickness of each layer can vary up to approximately 100% due to material selection and processing requirements. Thicknesses of the individual layers and corresponding final footbed thicknesses may vary to allow a comfortable fit for the end-user in the footwear. As shown in FIG. 4, the following steps may be followed to create a footbed according to the invention. First, a moldable sheet is molded into a contoured shape-retaining layer that has first and second major surfaces. After the thermal insulation has been placed on the molded shape-retaining layer, one or more layers of a third material may be juxtapositioned against the second major surface of the molded shape-retaining layer on top of the thermal insulation layer. The steps of the invention may, more specifically, be carried out using, for example, the materials listed above and the following steps:

1. A first foam sheet is placed into a thermoforming mold. The foam sheet is shaped through heat and compression while in the mold. Typical molding temperatures may be about 180 to 220° C. Multiple molds may be used to create multiple sizes to fit different shoe sizes. Alternatively, the sheet may be heated before being placed in a mold, which mold may be at room temperature.
2. The thermal insulation layer is cut into a shape that will fit in the heel section and that is smaller than the fore-part of the shape-retaining layer so that a user can cut the footbed to the proper size without cutting into the insulation. The insulation layer is then set on top of the molded shape-retaining layer using a dab of adhesive to hold it in place.
3. The conforming layer is cut into a shape of the heel-part and the full area of the forepart of the shape-retaining layer. An adhesive is applied to both major surfaces of the conforming layer.
4. The conforming layer is placed upon the second major surface of the insulation layer. An adhesive is applied to the first major surface of the fabric layer. The first major surface of the fabric layer is juxtaposed upon the second major surface of the layers below it.
5. The assembled layers are pressed together, the adhesive is cured, and the finished footbed is then die cut from the assembled layers.

In this method, the shape-retaining layer is molded separate from the thermal insulation and the other layers to preclude the detrimental affects of heat and pressure during molding. Also, the insulation, conforming, and top layers may be made from pliable materials so that they take on the shape of the molded, contoured shape-retaining without the need for being molded into that shape.

Alternative methods of assembly also may be used in conjunction with the present invention. For example, different bonding methods may be used, including ultrasonic welding, mechanical fastening, etc. Further, the footbed may be fashioned to be removable from a shoe, or it can be integrally disposed in the shoe by, for example, gluing or sewing. As used in this document, the term "integral" means not readily removable by simply grasping manually and pulling thereon. The footbed can be secured, for example, as a liner in the lower of the shoe interior.

EXAMPLE

Thickness Measurement

Final footbed thickness was measured per SATRA TM136 Method A using a SATRA model STD495 available from SATRA Technology Centre, Northhamptonshire, UK. The measurements were taken from the top of the foobed at the center of the heel-part and in the fore-part approximate where the ball of the foot would reside during use.

Thermal Resistance Test

The "Lee's disc" apparatus was used to determine thermal conductivity. Using the conductivity, and factoring in the sample thickness, a thermal resistance value was calculated. Thermal resistance equates to insulation performance. Thermal resistance using the "Lee's disc" apparatus was tested per SATRA TM146:1992. The equipment and test method are available from the SATRA Technology Centre. The resistance is reported in square meters ($m^2$) degrees Kelvin (K) per watt (W).

Air Permeability Test

"Gurley" is a measure of gas flow resistance of a membrane, expressed as the time necessary for a given volume of gas to pass through a standard area of test material under standard conditions, as specified in ASTM D726-58, Method A. Gurley is the time in seconds for 100 cubic centimeters (cc) of air, or another specified volume, to pass through 6.35 $cm^2$ (one square inch) of the membrane at a pressure of 124 mm of water. Shorter times mean higher air permeability.

The sample was measured using a Gurley Model 4110N that had a model 4320 Gurley digital readout available from Gurley Precision Instruments, Troy, N.Y., USA. The footbed sample was clamped between cylindrical rings, the uppermost of which rings contained a piston and the specified air volume. When released, the piston applied pressure, under its own weight, to the air in the upper cylinder, and the time taken for the specified volume of air to pass through the sample was measured. Three readings were taken on two different samples of each footbed. The results shown are an average of the readings. The footbeds were placed in the apparatus with the smoothest side up, thereby minimizing air leakage. As a result, Example 1 sample was top side up.

Example 1

A pair of footbeds was constructed as follows. A thermoformable, open cell, polyurethane foam containing antimicrobial agent and red pigment was obtained from Kun Huang Enterprise Co, LTD in Taiwan under the trademarked Poliyou brand. The antimicrobial agent was Aegis Microbe Shield AEM 5772 available from Aegis Environments, Midland, Mich., USA. The foam was molded into the desired contoured shape. The thermoforming temperature was about 180 to 220° C., and the dwell was about 90 to 120 seconds. The forming was done in a steel mold. The resulting first surface of the foam took the decorative shape disclosed in design patent application Ser. No. 29/323,304 to Anderson et al. filed Aug. 22, 2008. The second surface of the foam had the shape shown in FIG. 3. The thickness of the shape-retaining layer was tapered from about 6 mm at the center of the heel-part to about 2 mm at the center of the fore-part. An adhesive dab was applied to the bottom of the heel cavity. The adhesive was product 588T available from the Good Luck Resin Co, Ltd., China. A thermal insulation, which contains polypropylene microfibers was then die cut to fit in the heel cavity and was cut about 15 mm shorter (radically inward) than the full length of the footbed at the fore-part. The insulation used was Thinsulate™ Insulation Type B200 available from 3M Company, St. Paul, Minn. The insulation contains polypropylene as a majority constituent, which has a melting temperature of about 160° C. The insulation was then placed on top of the shape-retaining layer. A layer of the adhesive 588T was applied to the first and second major surfaces of the conforming layer and the first major surface of the top fabric layer. The top cover was a knit textile fabric, available as 180 gram per square meter black dyed BK Mesh from Lim Jun Textile Company, Taiwan. The slow recovery foam was 2.5 mm thick open cell polyurethane from Kun Huang Enterprise Co, Ltd. sold under the Imprint™ brand. The conforming and top fabric layers were juxtaposed against the insulation and shape-retaining layers. One hundred pounds of force was applied for 30 seconds using a flat press, ensuring good bonding of the layers. Individual left and right footbeds were then cut from the bonded four layer assembly. Finally, a heat sealable logo was applied to the exposed surface of the top cover in the heel area. The sample was tested for thermal resistance and air permeability:

TABLE 1

| Thermal Resistance | Air Permeability |
|---|---|
| 0.11 $m^2K/W$ | 8.6 seconds |

The results indicate that the Example footbed has a high thermal resistance and good air permeability.

This invention may take on various modifications and alterations without departing from its spirit and scope. Accordingly, this invention is not limited to the above-described but is to be controlled by the limitations set forth in the following claims and any equivalents thereof.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A footbed that comprises:

(a) a shape-retaining layer that has first and second major surfaces and that has a contour molded into the second major surface;

(b) a thermal insulation that comprises a non-woven web that contains polymeric microfibers and that has a loft of at least 5 cubic centimeters per gram, the non-woven web being juxtaposed against the shape-retaining layer such that the first major surface of the thermal insulation faces the second major surface of the shape-retaining layer; and (c) one or more layers of a third material that is juxtaposed against at least the second major surface of the non-woven web.

2. The footbed of claim 1, exhibiting a thermal resistance of at least 0.06 $m^2K/W$ when tested in accordance with the Thermal Resistance Test.

3. The footbed of claim 1, wherein the second major surface of the shape-retaining layer has a cavity 2 to 10 mm deep molded into a portion thereof.

4. The footbed of claim 1, wherein the shape-retaining layer, the nonwoven web, and the one or more layers of a third material are each air permeable.

5. The footbed of claim 1 wherein the one or more layers of a third material comprise a conforming foam layer and a fabric layer.

6. The footbed of claim 1, wherein the molded contour includes sidewalls that angle upwardly 5 to 90 degrees from a main plane of a top surface of the footbed.

7. The footbed of claim 1, wherein the loft of the nonwoven web is 10 to 35 $cm^3/g$.

8. The footbed of claim 1, wherein shape-retaining layer contains an air-permeable open-cell foam, the microfibers include meltblown microfibers, and the third material includes a conforming layer that contains an open-cell foam and a knit fabric as a top layer.

9. The footbed of claim 8, wherein the footbed has a total thickness of about 3 to 20 mm, with the molded shape-retaining layer being about 2 to 6 mm thick and comprising an open-cell foam.

10. A shoe that contains the footbed of claim 1 in a shoe interior.

11. A method of making a footbed, which method comprises the steps of:

(a) molding a sheet into a shape-retaining layer that has first and second major surfaces and that has a contour molded into the second major surface;

(b) juxtapositioning a thermal insulation layer, which comprises a non-woven web that contains microfibers and which has first and second major surfaces, onto the molded shape-retaining layer such that the first major surface of the insulation faces the second major surface of the shape-retaining layer; and (c) juxtapositioning one or more layers of a third material against at least the second major surface of the thermal insulation.

12. The method of claim 11, wherein the thermal insulation layer contains microfibers that have an effective fiber diameter of 1 to 15 micrometers.

13. The method of claim 12, wherein the contoured shape-retaining layer is air-permeable and the microfibers comprise a material that has a lower melting point than the temperature at which the air-permeable sheet is heated to during the molding step.

14. The method of claim 13, wherein the microfibers comprise polypropylene, and wherein the air-permeable sheet is heated to about 170° C. or higher during the molding step.

15. The method of claim 14, wherein the third material comprises first and second major surfaces and an open-cell foam layer and a textile layer, wherein the textile layer comprises the second major surface of the third material and forms a top exposed layer of the shoe footbed.

16. The method of claim 11, wherein the assembled footbed is air-permeable.

17. A method of making a shoe, which method comprises placing the assembled footbed of claim 11 into a shoe interior.

18. A method of making a shoe, which method comprises placing the assembled footbed of claim 16 into a shoe interior.

* * * * *